United States Patent [19]

Yoshikawa et al.

[11] Patent Number: 5,059,890

[45] Date of Patent: Oct. 22, 1991

[54] CONSTANT CURRENT SOURCE CIRCUIT

[75] Inventors: Yoshinori Yoshikawa, Kawasaki; Kunihiko Gotoh, Tama, both of Japan

[73] Assignee: Fujitsu Limited, Kawasaki, Japan

[21] Appl. No.: 446,885

[22] Filed: Dec. 6, 1989

[30] Foreign Application Priority Data

Dec. 9, 1988 [JP] Japan ..... 63-312535

[51] Int. Cl.[5] ..... G05F 3/26

[52] U.S. Cl. ..... 323/315; 307/296.1

[58] Field of Search ..... 323/313-316; 307/296.1, 296.6

[56] References Cited

U.S. PATENT DOCUMENTS

| | | | |
|---|---|---|---|
| 3,899,692 | 8/1975 | Caswell . | |
| 4,020,367 | 4/1977 | Yamashiro et al. . | |
| 4,031,456 | 6/1977 | Shimada et al. . | |
| 4,270,081 | 5/1981 | Hareyama . | |
| 4,292,584 | 9/1981 | Kusakabe | 326/316 |
| 4,325,018 | 4/1982 | Schade, Jr. . | |
| 4,327,321 | 4/1982 | Suzuki et al. | 325/315 |
| 4,352,057 | 9/1982 | Okada et al. | 323/315 |
| 4,359,680 | 11/1982 | Hellums et al. . | |
| 4,361,797 | 11/1982 | Kojima et al. | 323/316 |
| 4,419,594 | 12/1983 | Gemmell et al. . | |
| 4,498,041 | 2/1985 | Kuwahara | 323/316 |
| 4,578,633 | 3/1986 | Aoki | 323/315 |
| 4,591,780 | 5/1986 | Yamada et al. | 323/313 |
| 4,603,290 | 7/1986 | Shinomiya | 323/315 |
| 4,645,948 | 2/1987 | Morris et al. | 307/296.1 |
| 4,727,309 | 2/1988 | Vajdic et al. | 323/315 |
| 4,733,161 | 3/1988 | Kuwahara | 323/315 |
| 4,780,624 | 10/1988 | Nicollini et al. | 307/296.1 |

FOREIGN PATENT DOCUMENTS

| | | |
|---|---|---|
| 3713107A1 | 10/1987 | Fed. Rep. of Germany . |
| 82/01776 | 5/1982 | PCT Int'l Appl. . |

OTHER PUBLICATIONS

"DTMF/Pulse Dialer LSI", T. Saitoh et al., The Institute of Electronics and Communication Engineers of Japan Integrated Nationalwide Meetings, pp. 2-176, 1985.

RCA Review, vol. 39, No. 2, Jun. 1978, pp. 250-258, Otto H. Schade, Jr., "Advances in Bimos Integrated Circuits".

*Primary Examiner*—Steven L. Stephan
*Assistant Examiner*—Emanuel Todd Voeltz
*Attorney, Agent, or Firm*—Armstrong, Nikaido, Marmelstein, Kubovcik & Murray

[57] ABSTRACT

A constant current source circuit includes a current mirror circuit supplying a load circuit with an output current which is regulated on the basis of a reference current, a transistor having an emitter, a collector connected to a first power source line, and a base coupled to the current mirror circuit, and a resistor coupled between the emitter and base. The reference current passes through the resistor. A current control circuit controls a current directed to a second power source line in accordance with a bias voltage. The above current consists of the reference current and a collector current passing through the transistor. A bias circuit having a current path derives the bias voltage from a current passing from the first power source line to the second power source line through the current path.

19 Claims, 7 Drawing Sheets

CONSTANT CURRENT SOURCE CIRCUIT

BACKGROUND OF THE INVENTION

The present invention generally relates to a constant current source circuit and, more particularly, to a constant current source circuit suitable for battery-based applications.

Recently, an electronic circuit has been demanded which can operate over a wide power source voltage range. In some applications, typically, battery-based applications, an electronic circuit designed to operate with a 5 V-based standard power source voltage is required to stably operate with a decreased power source voltage of 3 volts or 2 volts, for example. The present invention is directed to a constant current source circuit capable of providing an electronic circuit with sufficient current even when the power source voltage decreases so that the electronic circuit can operate correctly.

Referring to FIG. 1A, there is illustrated a conventional constant current source circuit (see T. Saito et al., "DTMF/PULSE DIALER LSI", The Institute of Electronics and Communication Engineers of Japan Integrated Nationalwide Meetings, pp. 2-176, 1985, for example). The illustrated circuit includes an npn-type bipolar transistor (hereinafter simply referred to as a transistor) 1. A load resistor 7 is connected to the emitter of the transistor 1, and a resistor 2 is connected between the base and the emitter. A current Iref passes through the resistor 2. A current mirror circuit 4 utilizes the current Iref as a reference current, and supplies a load circuit 5 with an output current Io. As shown in FIG. 1B, the current mirror circuit 4 is made up of two p-channel MOS transistors **4*a* and 4*b***.

A current Ia passing through the resistor 7 is written:

$$Ia = Ic + Iref = (1+\beta)Iref \quad (1)$$

where Ic is the collector current, and B is the current transfer ratio of the transistor I. The current Ia is written as follows also:

$$Ia = Va/r_1 \quad (2)$$

where Va is a voltage across the resistor 7, and $r_1$ is a resistance of the resistor 7. The voltage Va is equal to a voltage obtained by subtracting the sum of a voltage drop caused in the current mirror circuit 4 and a base-emitter voltage $V_{BE}$ of the transistor 1 from a positive power source voltage $V_{DD}$. That is, the voltage Va across the resistor 7 is expressed as follows:

$$Va = V_{DD} - [(|V_{th}| - \Delta_1) + (V_{BE} + \Delta_2)] \quad (3)$$

where $|V_{th}|$ is an absolute value of the threshold voltage of the MOS transistor **4*a***, $\Delta_1$ is an error voltage of the voltage $V_{th}$, and $\Delta_2$ is an error voltage of the base-emitter voltage $V_{BE}$.

Normally, the sum of the absolute value of the threshold voltage $V_{th}$ and the error voltage $\Delta_1$ is approximately 1.0 V, and the sum of the base-emitter voltage $V_{BE}$ and the error voltage $\Delta_2$ is approximately 0.7 V. In this case, when the power source voltage $V_{DD}$ is equal to 5 V, the voltage Va (hereinafter referred to as $Va_1$ with equal to 5 V) is approximately 3.3 V. In this case, the current Ia ($Ia_1$) is $$Ia_1 = 3.3/r_1. \quad (4)$$

When the power source voltage $V_{DD}$ is equal to 2 V, the voltage Va (hereinafter referred to as $Va_2$ with $V_{DD}$ equal to 2 V) is approximately 0.3 V. In this case, the current Ia ($Ia_2$) is as follows:

$$Ia_2 = 0.3/r_1. \quad (5)$$

The following formula can be obtained from the formulas (4) and (5):

$$Ia_2 = I_{a1}/11. \quad (6)$$

That is, the current $Ia_2$ with equal to 2 V is one-eleventh as large as the current $Ia_1$ with equal to 5 V. Thus, the output current Io decreases drastically, which causes a malfunction of the load circuit 5. For example, load circuit 5 may oscillate, or the frequency characteristics thereof may change.

SUMMARY OF THE INVENTION

Accordingly, a general object of the present invention is to an improved constant current source circuit in which the aforementioned disadvantages are overcome.

A more specific object of the present invention is to provide a constant current source circuit in which a decrease of the output current derived from the current mirror circuit is suppressed even when the power source voltage decreases drastically.

The above objects of the present invention are achieved by a constant current source circuit comprising a current mirror circuit supplying a load circuit with an output current which is regulated on the basis of a reference current; a transistor having an emitter, a collector connected to a first power source line, and a base coupled to the current mirror circuit; a resistor coupled between the emitter and base, the reference current passing through the resistor; current control means, coupled to the emitter, for controlling a current directed to a second power source line in accordance with a bias voltage, the current composed of the reference current and a collector current passing through the transistor; and bias means, coupled to the current control means and having a current path, for deriving the bias voltage from a current passing from the first power source line to the second power source line through the current path.

The aforementioned objects of the present invention are also achieved by a constant current power source circuit comprising a current mirror circuit supplying a load circuit with an output current which is regulated on the basis of a first reference current; a transistor having an emitter, a collector connected to a first power source line, and a base coupled to the current mirror circuit; a resistor coupled between the emitter and base, the first reference current passing through the resistor; and current mirror means, coupled to the emitter of the transistor, for controlling a current directed to a second power source line in accordance with a second reference current, the current composed of the reference current and a collector current passing through the transistor, and the second reference current being directed from the first power source line to the second power source line.

The aforementioned objects of the present invention are also achieved by a constant current source circuit adapted to a differential amplifier circuit including first and second transistors having sources mutually connected so as to configure a differential circuit and including a third transistor which is coupled between the sources and a first power source line and passes a current from the sources to the first power source line, the third transistor having a gate coupled to the constant current source circuit. The constant current source circuit comprises a current mirror circuit supplying a load circuit with an output current which is regulated on the basis of a reference current; a transistor having an emitter, a collector connected to a second power source line, and a base coupled to the current mirror circuit; a resistor coupled between the emitter and base, the reference current passing through the resistor; current control means, coupled to the emitter, for controlling a current directed to the first power source line in accordance with a bias voltage, the current composed of the reference current and a collector current passing through the transistor; and bias means, coupled to the current control means and having a current path, for deriving the bias voltage from a current passing from the second power source line to the first power source line through the current path.

Additional objects, features and advantages of the present invention will become apparent from the following detailed description when read in conjunction with the accompanying drawings.

DESCRIPTION OF THE PREFERRED EMBODIMENTS

Figure 1A:
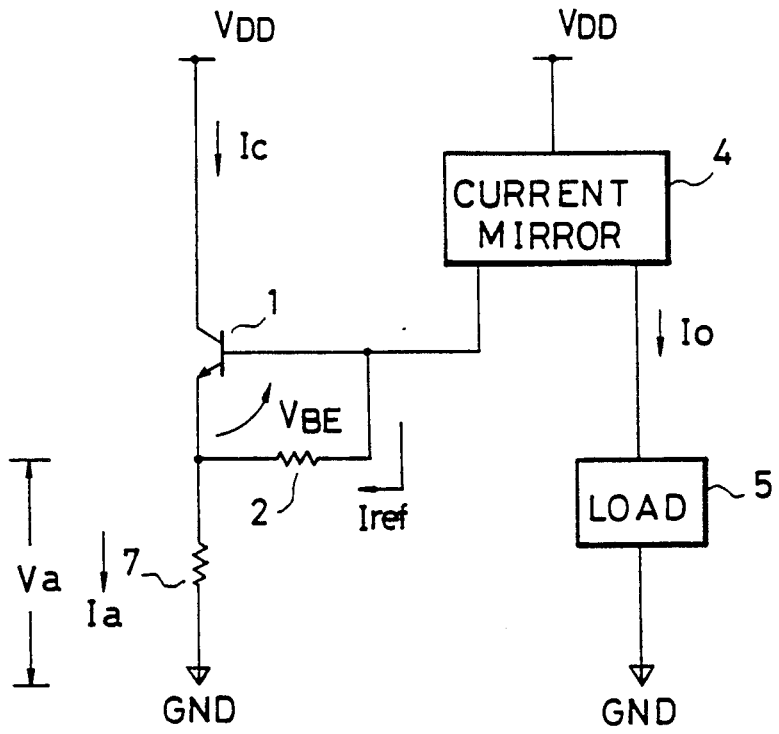
FIG. 1A PRIOR ART
FIG. 1A is a circuit diagram of a conventional constant current source circuit.
Figure 1B:
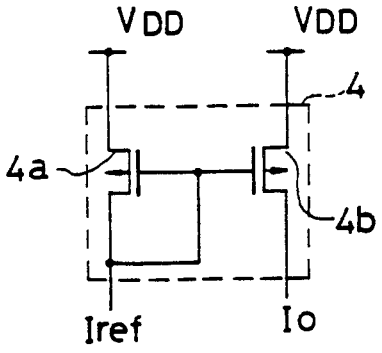
FIG. 1B PRIOR ART
FIG. 1B is a circuit diagram of a current mirror circuit used in the circuit shown in FIG. 1A.
Figure 2:
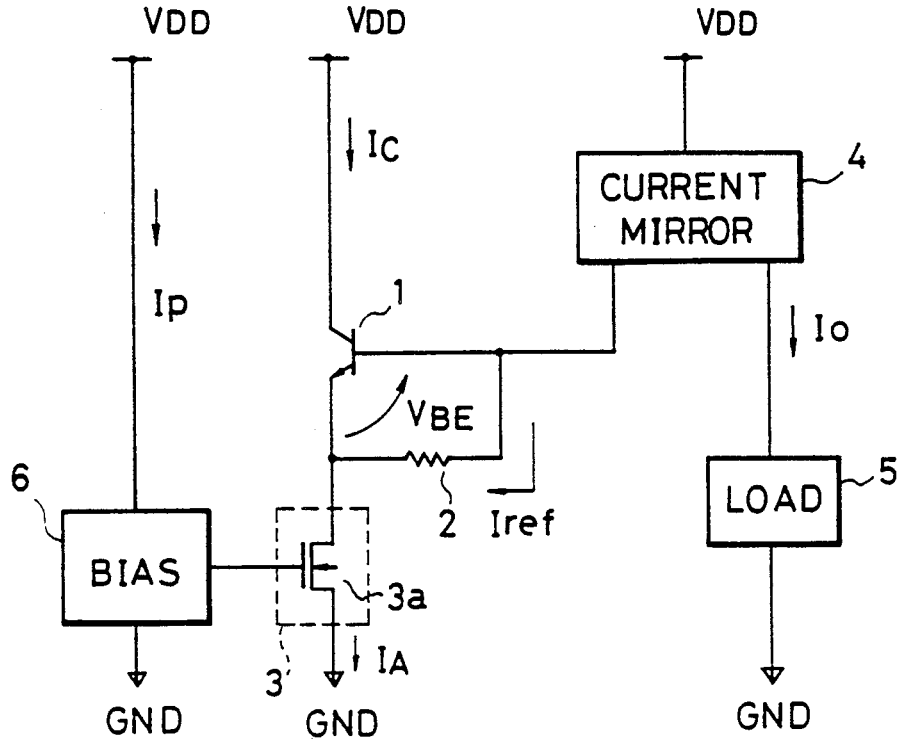
FIG. 2 is a circuit diagram of a constant current power source circuit according to a preferred embodiment of the present invention.

A description is given of a preferred embodiment of the present invention with reference to FIG. 2, in which those parts which are the same as those shown in FIGS. 1A and IB are given the same reference numerals.

An essential feature of the embodiment is that a current control circuit 3 is substituted for the resistor 7 shown in FIG. 1A, and the current control circuit 3 is biased by a bias circuit (current path) 6 connected between the positive power source $V_{DD}$ and the negative power source GND, which is provided by a battery, for example. The current control circuit 3 includes an n-channel MOS transistor 3*a*. The bias circuit 6 supplies the gate of the MOS transistor 3*a* with a bias voltage dependent on the power source voltage $V_{DD}$. The bias circuit 6 presents a constant voltage drop $V_P$. A current $I_P$ defined by the following formula passes through the bias circuit 6:

$$I_P=(V_{DD}-V_P)/R \tag{7}$$

where R is a resistance contained in the bias circuit 6. When the power source voltage $V_{DD}$ is 5 V and the voltage drop $V_P$ is set equal to 1 V, the current $I_P$ (labeled $I_{P1}$ for this voltage value) is written as follows:

$$I_{P1}=(5-1)/R=4/R. \tag{8}$$

When the power source voltage $V_{DD}$ decreases to 2 V, the current $I_P$ (labeled $I_{P2}$ for this voltage) is written as follows:

$$I_{P2}=(2-1)/R=1/R. \tag{9}$$

The following formula is obtained from the formulas (8) and (9):

$$I_{P2}=I_{P1}/4. \tag{10}$$

A current $I_A$ passing through the current control circuit 3 is proportional to the current $I_P$. Thus, it can be seen from comparison between formulas (6) and (10) that a decrease of the current $I_A$ passing through the current control circuit 3 is drastically suppressed as compared with the conventional configuration shown in FIG. 1A. As a result, the load circuit 5 can operate with a large decrease of the power source voltage $V_{DD}$. In other words, the present constant current source circuit can drive a variety of load circuits having different standard power source voltages.

Figure 3:
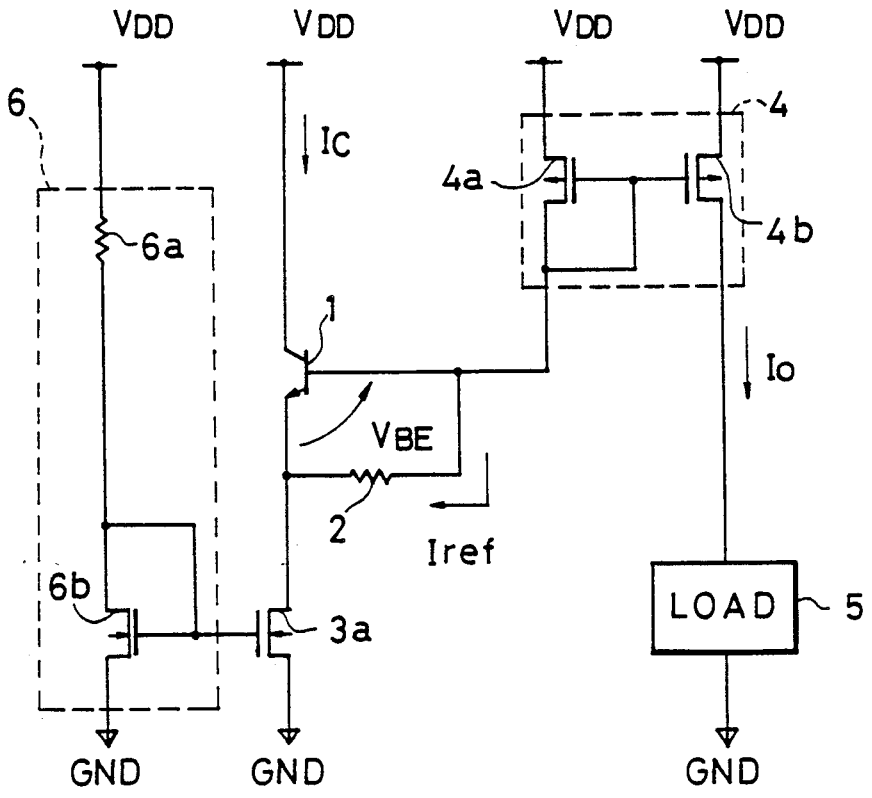
FIG. 3 is a circuit diagram of a detailed configuration of the constant current power source circuit.

FIG. 3 is a circuit diagram of a detailed configuration of the constant current source circuit 6 shown in FIG. 2. Referring to FIG. 3, the bias circuit 6 is made up of a resistor 6*a* and an n-channel MOS transistor 6*b* which are connected in series. The MOS transistors 3*a* and 6*b* configure a current mirror circuit. The resistor 6*a* presents the aforementioned resistance R of the bias circuit 6. The resistor 6*a* is a diffusion resistor or a polysilicon resistor, for example. The drain of the MOS transistor 6*b* is connected to the gate thereof. The source of the MOS transistor 6*b* is connected to the power source GND. As described previously, when the power source voltage $V_{DD}$ decreases from 5 V to 2 V, the current $I_A$ decreases to $I_A/4$. It is noted that even when the current $I_A$ decreases to one-quarter, the output current Io does not decrease as much as one-quarter. When the reference current Iref is equal to or less than a predetermined current, a variation of the reference current Iref is absorbed to an extent between the base and emitter of the transistor 1, or in other words, the base-emitter voltage $V_{BE}$ is maintained at a voltage of about 0.6 V. For this reason, even when there is a variation of the current $I_A$, the reference current Iref is not affected greatly. Since a decrease of the current $I_A$ is drastically suppressed, a decrease of the collector current Ic is also suppressed.

Figure 4:
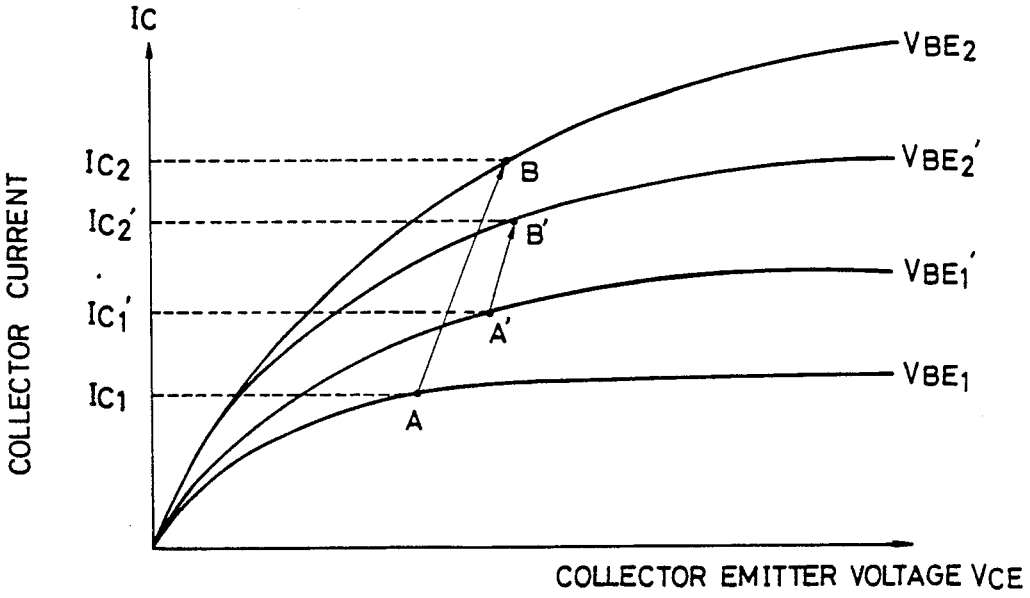
FIG. 4 is a graph illustrating collector current v. collector-emitter voltage characteristics.

FIG. 4 is a graph illustrating collector current v. collector-emitter voltage characteristics. It is now assumed that the power source voltage $V_{DD}$ changes from $V_{DD1}$ to $V_{DD2}$ where $V_{DD1}<V_{DD2}$. In the conventional configuration shown in FIG. 1A, the collector current Ic changes from $Ic_1$ to $Ic_2$ and correspondingly the base-emitter voltage $V_{BE}$ changes from $V_{BE1}$ to $V_{BE2}$. In this case, the operating point of the transistor 1 changes from A to B shown in FIG. 4. On the other hand, in the configuration shown in FIG. 3, the collector current Ic changes from $Ic_1'$ to $IC_2'$, and the base-emitter voltage $V_{BE}$ changes from $V_{BE1}'$ to $V_{BE2}'$. In this case, the operating point of the transistor 1 changes only from A' to B'. Since the following formula is satisfied;

$$|Ic_2 - Ic_1| > |Ic_2' - Ic_1'| \quad (11)$$

the following formula is established:

$$|V_{BE2} - V_{BE1}| > |V_{BE2}' - V_{BE1}'|. \quad (12)$$

It can be seen from the graph of FIG. 4 that the current current Ic does not much depend on variations of the power source voltage $V_{DD}$ and thus variations of the output current Io are greatly suppressed.

Figure 5C:
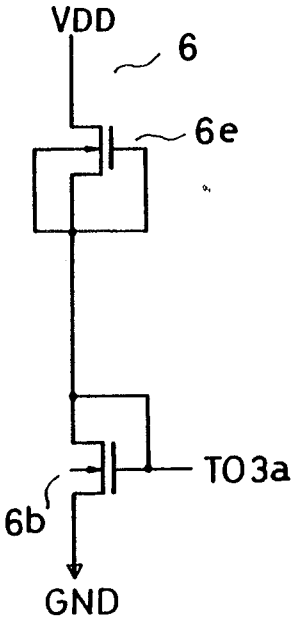
FIGS. 5A through 5C are circuit diagrams illustrating variations of a bias circuit shown in FIG. 3.
Figure 5B:
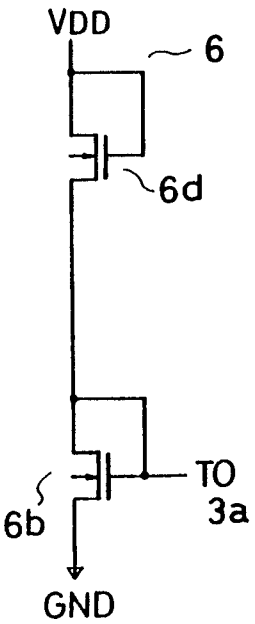
Figure 5A:
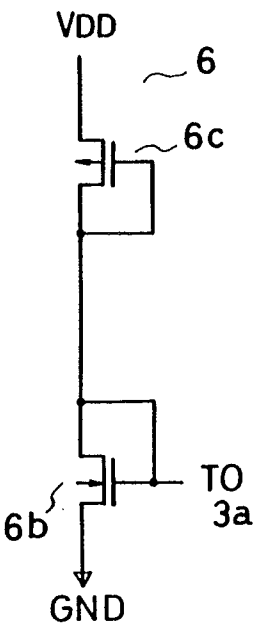

The resistor 6*a* shown in FIG. 3 is replaced by another element. For example, as shown in FIG. 5A, a p-channel MOS transistor 6*c* serving as a resistor is interposed between the power source $V_{DD}$ and the MOS transistor 6*b*. The source of the MOS transistor 6*c* is connected to the power source $V_{DD}$, and the mutually connected drain and gate thereof are connected to the drain of the MOS transistor 6*b*. As shown in FIG. 5B, an n-channel MOS transistor 6*d* is provided between the power source $V_{DD}$ and the MOS transistor 6*b*. The mutually connected drain and gate of the MOS transistor 6*d* are connected to the power source $V_{DD}$, and the source thereof is connected to the drain of the MOS transistor 6*b*. As shown in FIG. 5C, a depletion type MOS transistor 6*e* is provided between the power source $V_{DD}$ and the MOS transistor 6*b*.

Figure 6:
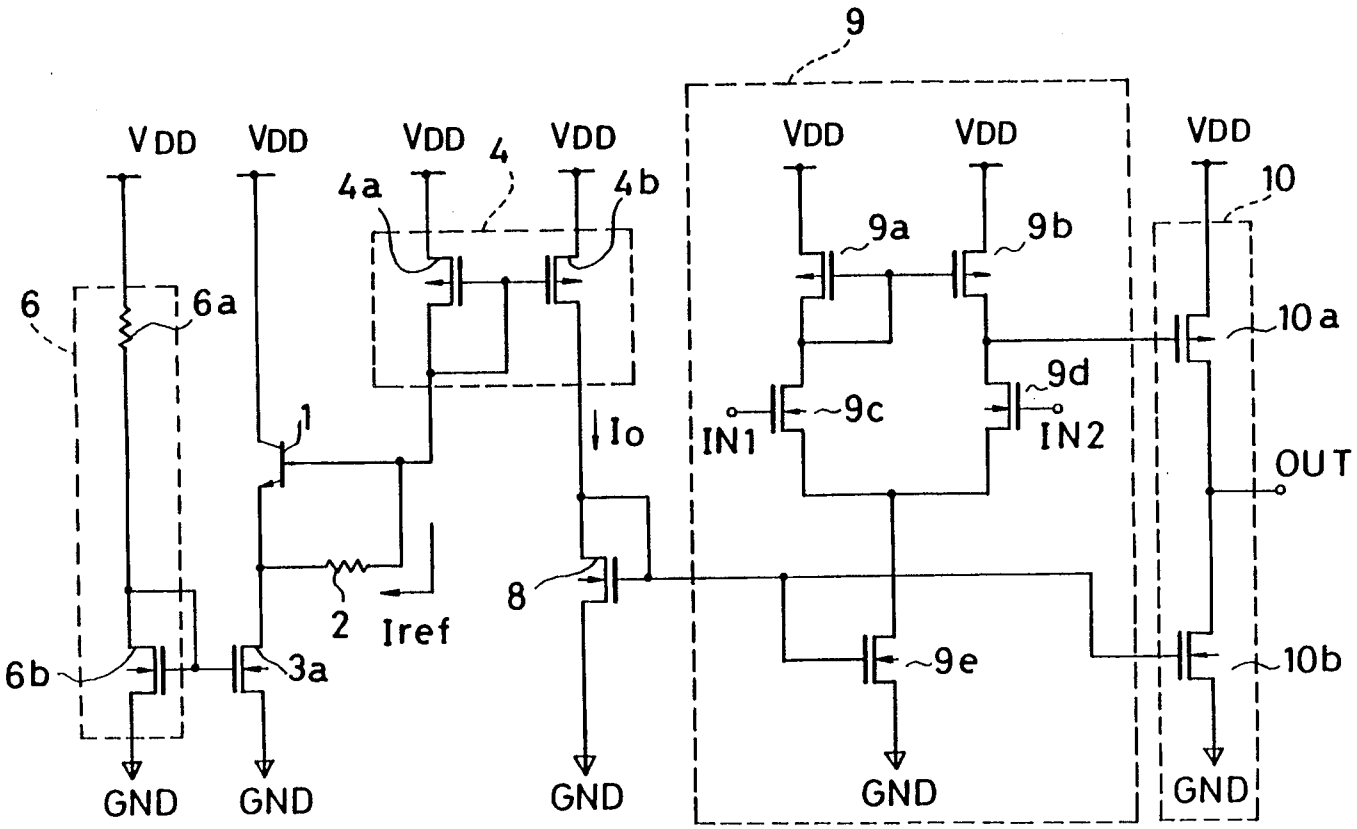
FIG. 6 is a circuit diagram of an application of the present invention.

FIG. 6 is a circuit diagram of an application of the present invention. In FIG. 6, those parts which are the same as those in the previous figures are given the same reference numerals. The present constant current source circuit is applied to a conventional differential amplifier 9 followed by an output circuit 10.

Referring to FIG. 6, an n-channel MOS transistor 8 converts the output current Io from the current mirror circuit 4 into a corresponding bias voltage. The converted bias voltage is applied to the differential amplifier 9, which is made up of two p-channel MOS transistors 9*a*, 9*b*, and three n-channel MOS transistors 9*c*, 9*d* and 9*e*. Input signals IN1 and IN2 are applied to the gates of the MOS transistors 9*c* and 9*d*, respectively. The output circuit 10 is made up of a p-channel MOS transistor 10*a* and an n-channel MOS transistor 10*b*. The differential amplifier 9 has two outputs, one of which is applied to the gate of the MOS transistor 10*a*, and the other of which is applied to the gate of the MOS transistor 10*b*. The drains of the MOS transistors 10*a* and 10*b* are mutually connected, through which an output signal OUT is drawn.

Figure 7:
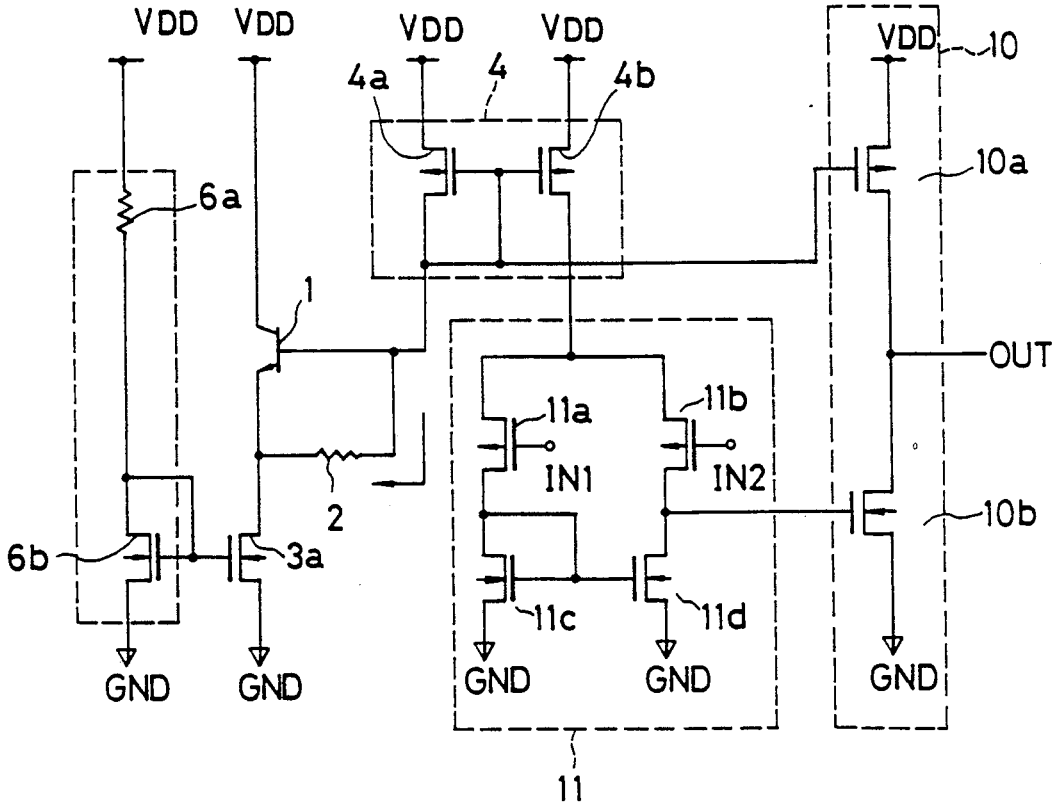
FIG. 7 is a circuit diagram of another application of the present invention.

FIG. 7 illustrates another application of the present invention. In FIG. 7, those parts which are the same as those shown in the previous figures are given the same reference numerals. The present constant power source circuit is applied to a differential amplifier 11. It is noted that the MOS transistor 4*b* is used in common with the current mirror circuit 4 and the differential amplifier 11. That is, the MOS transistor 4*b* is one of the elements of the current mirror circuit 4, and serves as a constant current source transistor of the differential amplifier 11. As illustrated, the differential amplifier 11 is made up of two p-channel MOS transistors 11*a*, 11*b*, and two n-channel MOS transistors 11*c* and 11*d*.

Figure 8B:
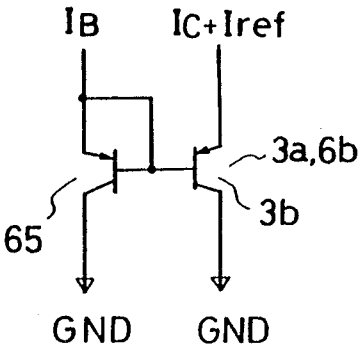
FIGS. 8A and 8B are circuit diagrams of variations of the current mirror circuit used in the present invention.
Figure 8A:
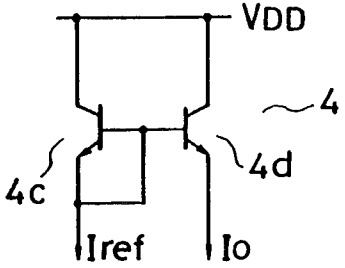

FIG. 8A is a circuit diagram of an alternative current mirror circuit which can be substituted for the current mirror circuit 4. As shown, the alternative is made up of two npn-type bipolar transistors 4*c* and 4*d*.

FIG. 8B is a circuit diagram of an alternative of the current mirror circuit consisting of the MOS transistor 3*a* and 6*b*. The alternative is composed of two pnp-type bipolar transistors 3*b* and 6*f*.

The present invention is not limited to the aforementioned embodiments, and variations and modifications may be made without departing from the scope of the present invention.

What is claimed is:

1. A constant current source circuit comprising:

a current mirror circuit supplying a load circuit with an output current which is regulated on the basis of a reference current;

a transistor having an emitter, a collector connected to a first power source line, and a base coupled to said current mirror circuit;

a resistor coupled between said emitter and base, said reference current passing through said resistor;

current control means, coupled to said emitter, for controlling a current directed to a second power source line in accordance with a bias voltage, said current composed of said reference current and a collector current passing through said transistor; and bias means, coupled to said current control means and having a current path, for deriving said bias voltage from a current passing from said first power source line to said second power source line through said current path.

2. A constant current source circuit as claimed in claim 1, wherein said current control means comprises a metal-oxide-semiconductor (MOS) transistor coupled between the emitter of said transistor and said second power source line, and said MOS transistor has a gate to which said bias voltage supplied from said bias means is applied.

3. A constant current source circuit as claimed in claim 1, wherein said bias means comprises a resistor having a first terminal coupled to said first power source line and a second terminal, and an n-channel MOS transistor having a drain coupled to the second terminal of said resistor, a gate coupled to said drain, and a source coupled to said second power source line, and wherein said bias voltage is drawn from the gate of said n-channel MOS transistor.

4. A constant current source circuit as claimed in claim 1, wherein said bias means comprises a p-channel MOS transistor having a source coupled to said first power source line, a gate, and a drain coupled to said gate, and an n-channel MOS transistor having a drain coupled to the gate and drain of said p-channel MOS transistor, a gate coupled to the drain thereof, and a source coupled to said second power source line, and wherein said bias voltage is drawn from the gate of said n-channel MOS transistor.

5. A constant current source circuit as claimed in claim 1, wherein said bias means comprises a first n-channel MOS transistor having a drain coupled to said first power source line, a gate coupled to said drain thereof, and a source, and a second n-channel MOS transistor having a drain coupled to the source of said first n-channel MOS transistor, a gate coupled to said drain thereof, and a source coupled to said second power source line, and wherein said bias voltage is drawn from the gate of said second n-channel MOS transistor.

6. A constant current source circuit as claimed in claim 1, wherein said bias means comprises a depletion type MOS transistor.

7. A constant current source circuit as claimed in claim 3, wherein said resistor comprises a diffusion resistor.

8. A constant current source circuit as claimed in claim 3, wherein said resistor comprises a polysilicon resistor.

9. A constant current source circuit as claimed in claim 1, wherein said transistor is an npn-type bipolar transistor.

10. A constant current source as claimed in claim 1, wherein said first and second power source lines receive a power source voltage from a battery.

11. A constant current source circuit as claimed in claim 1, wherein said load circuit comprises a MOS transistor having a drain coupled to said current mirror circuit, a source coupled to said second power source line, and a gate coupled to said drain.

12. A constant current source circuit comprising:

a current mirror circuit supplying a load circuit with an output current which is regulated on the basis of a first reference current;

a transistor having an emitter, a collector connected to a first power source line, and a base coupled to said current mirror circuit;

a resistor coupled between said emitter and base, said first reference current passing through said resistor; and current mirror means, coupled to the emitter of said transistor, for controlling a current directed to a second power source line in accordance with a second reference current, said current composed of said second reference current and a collector current passing through said transistor, and said second reference current being directed from said first power source line to said second power source line; wherein the second reference current flows to the second power source line from the first power source line through a current path which is different from current paths through which the output current and the first reference current respectively pass.

13. A constant current source circuit as claimed in claim 12, wherein said current mirror means comprises voltage drop means for deriving a voltage drop from said second reference current, and a pair of transistors which are connected so as to configure a current mirror circuit, and wherein said second reference current passes through one of said pair of transistors, and said current passes through the other of said pair of transistors.

14. A constant current source circuit as claimed in claim 13, wherein said pair of transistors are MOS transistors.

15. A constant current source circuit as claimed in claim 13, wherein said pair of transistors are bipolar transistors.

16. A constant current source circuit as claimed in claim 13, wherein said voltage drop means comprises a resistor.

17. A constant current source circuit as claimed in claim 12, wherein said first and second power source lines receive a power source voltage from a battery.

18. A constant current source circuit as claimed in claim 12, wherein said load circuit comprises a MOS transistor having a drain coupled to said current mirror circuit, a source coupled to said second power source line, and a gate coupled to said drain.

19. A constant current source circuit adapted to a differential amplifier circuit including first and second transistors having sources mutually connected so as to configure a differential circuit and including a third transistor which is coupled between said sources and a first power source line and passes a current from said sources to said first power source line, said third transistor having a gate coupled to said constant current source circuit, said constant current source circuit comprising:

a current mirror circuit supplying a load circuit with an output current which is regulated on the basis of a reference current;

a transistor having an emitter, a collector connected to a second power source line, and a base coupled to said current mirror circuit;

a resistor coupled between said emitter and base, said reference current passing through said resistor;

current control means, coupled to said emitter, for controlling a current directed to said first power source line in accordance with a bias voltage, said current composed of said reference current and a collector current passing through said transistor; and bias means, coupled to said current control means and having a current path, for deriving said bias voltage from a current passing from said second power source line to said first power source line through said current path.

* * * * *